US008535592B2

(12) United States Patent
Halischuk

(10) Patent No.: US 8,535,592 B2
(45) Date of Patent: Sep. 17, 2013

(54) CONCRETE FORMS

(76) Inventor: Cory Halischuk, Clandeboye (CA)

( * ) Notice: Subject to any disclaimer, the term of this patent is extended or adjusted under 35 U.S.C. 154(b) by 617 days.

(21) Appl. No.: 12/609,927

(22) Filed: Oct. 30, 2009

(65) Prior Publication Data

US 2010/0107552 A1 May 6, 2010

Related U.S. Application Data

(60) Provisional application No. 61/110,008, filed on Oct. 31, 2008.

(51) Int. Cl.
*B28B 13/06* (2006.01)
*B28B 1/14* (2006.01)
*B28B 7/26* (2006.01)

(52) U.S. Cl.
USPC ..... 264/334; 264/333

(58) Field of Classification Search
USPC ..... 264/333, 334
See application file for complete search history.

(56) References Cited

U.S. PATENT DOCUMENTS

| | | | | |
|---|---|---|---|---|
| 1,644,586 | A * | 10/1927 | Heltzel | 249/5 |
| 3,695,574 | A * | 10/1972 | Charlier et al. | 249/175 |
| 3,730,475 | A | 5/1973 | Werfel | |
| 6,059,256 | A * | 5/2000 | Matthews | 249/10 |
| 2002/0152709 | A1 * | 10/2002 | Gresser et al. | 52/604 |

* cited by examiner

*Primary Examiner* — Christina Johnson
*Assistant Examiner* — Patrick Butler
(74) *Attorney, Agent, or Firm* — Adrian D. Battison; Ade & Company Inc.

(57) ABSTRACT

A concrete footing is laid by a set of forms each with side walls forming an elongate area and transverse connecting elements with at least one lift element mounted for lifting by a fork lift system extending across the side walls. The forms include legs engaged into the ground and adjusted to a required height relative to the ground. After setting of the concrete the elongate frame members are lifted from the concrete using the fork lift system. Connecting members shaped to match the side walls are clamped on an inside surface so as to bridge between the frame members. The set is carried on a transport cradle which includes a pair of side walls on which a lowermost one of the set sits with a pair of transverse sleeves connected across the side walls by which the cradle is lifted by the forks of the fork lift system.

11 Claims, 5 Drawing Sheets

CONCRETE FORMS

This application claims the benefit under 35 U.S.C.119 of Provisional Application 61/110,008, filed Oct. 31, 2008.

This invention relates to a set of concrete forms which can be readily moved and placed in required locations for use in casting concrete.

BACKGROUND OF THE INVENTION

U.S. Pat. No. 3,730,475 (Werfel) issued May 1, 1973 discloses a form for use in casting a foundation or footing where there are two side walls converging upwardly and inwardly to an open top where the side walls are bridged by pair of straps with top portions which can be used as handles. The forms are arranged in a row to define the footing and cab be lifted off after the concrete is poured and set.

The forms are not however convenient to use and to adjust to the required position.

SUMMARY OF THE INVENTION

It is one object of the invention to provide a set of forms which can be readily and easily moved to a required location and located in place for casting concrete within the forms.

According to one aspect of the invention there is provided a method of laying a concrete footing comprising:

providing a set of forms each comprising:

an elongate frame member arranged to define side walls forming an elongate area therebetween into which concrete can be cast for setting into a shape defined by the side walls;

transverse connecting elements for connecting the side walls together for holding them at a required spacing defining the area;

each of the frame members having at least one lift element mounted thereon defining an opening extending in a direction transverse to the side walls;

lifting the respective frame member by a respective fork of a fork lift system extending across the side walls;

placing the respective frame member at a required location;

engaging legs on the frame members on the ground at a required height relative to the ground;

adjusting the legs in height to level the frame members at a required orientation relative to the ground;

pouring the concrete;

and after setting of the concrete lifting the elongate frame members from the concrete using the fork lift system engaging the lift element.

Preferably the method includes providing a plurality of connecting members each shaped to match a respective one of the side walls and clamped thereto on an inside surface thereof so as to bridge between a respective elongate frame member and a next adjacent elongate frame member.

Preferably the method includes providing a transport cradle on which the set of elongate frame members is stacked.

Preferably the cradle includes a pair of side walls on which a lowermost one of the set sits with a pair of transverse sleeves connected across the side walls by which the cradle is lifted by the forks of the fork lift system.

The sleeve element may be formed by a tube which is complete to surround the fork along a part of the length of the fork or may be just loops at spaced positions or may only partly surround the fork provided the sleeve member provides sufficient engagement with the fork so that the sleeve and the form attached thereto are moved by t the fork accurately to a required location defined by the fork.

Preferably the sleeve element is arranged to extend across the frame member at right angles to the side walls. This allows the form to be placed from one side with the fork extending across the form. However other arrangement may be possible.

Preferably there is a single sleeve element mid way along the frame member for lifting by a single fork. Although two such sleeve elements may be used for a dual fork arrangement.

Preferably the sleeve element comprises a tube formed between two upstanding flanges connected across the side walls.

Preferably the side walls are connected by upstanding flange members extending transversely thereof.

Preferably there are four legs arranged substantially at opposite corners.

Preferably each leg includes a spike portion for engagement into the ground and a transverse flange for location a depth of the leg relative to the ground.

Preferably the spike comprises a plate which is chamfered to define a point at a bottom end of the plate.

Preferably the transverse flange extends at right angels to the plate.

Preferably each side wall includes a bottom vertical section and an upwardly and inwardly inclined upper section.

Preferably there is provided a corner piece for connecting longitudinal pieces wherein the corner piece includes side walls arranged at right angles to each other and wherein the sleeve element extends diagonally of the corner.

The arrangement above is particularly designed for use in a method using a fork lift system on a skid steer loader including lifting and manipulating the forms to required locations by inserting a fork of the skid steer loader into the sleeve element, moving the form to a required location on the ground and pressing the form by the fork onto the ground at the required location.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
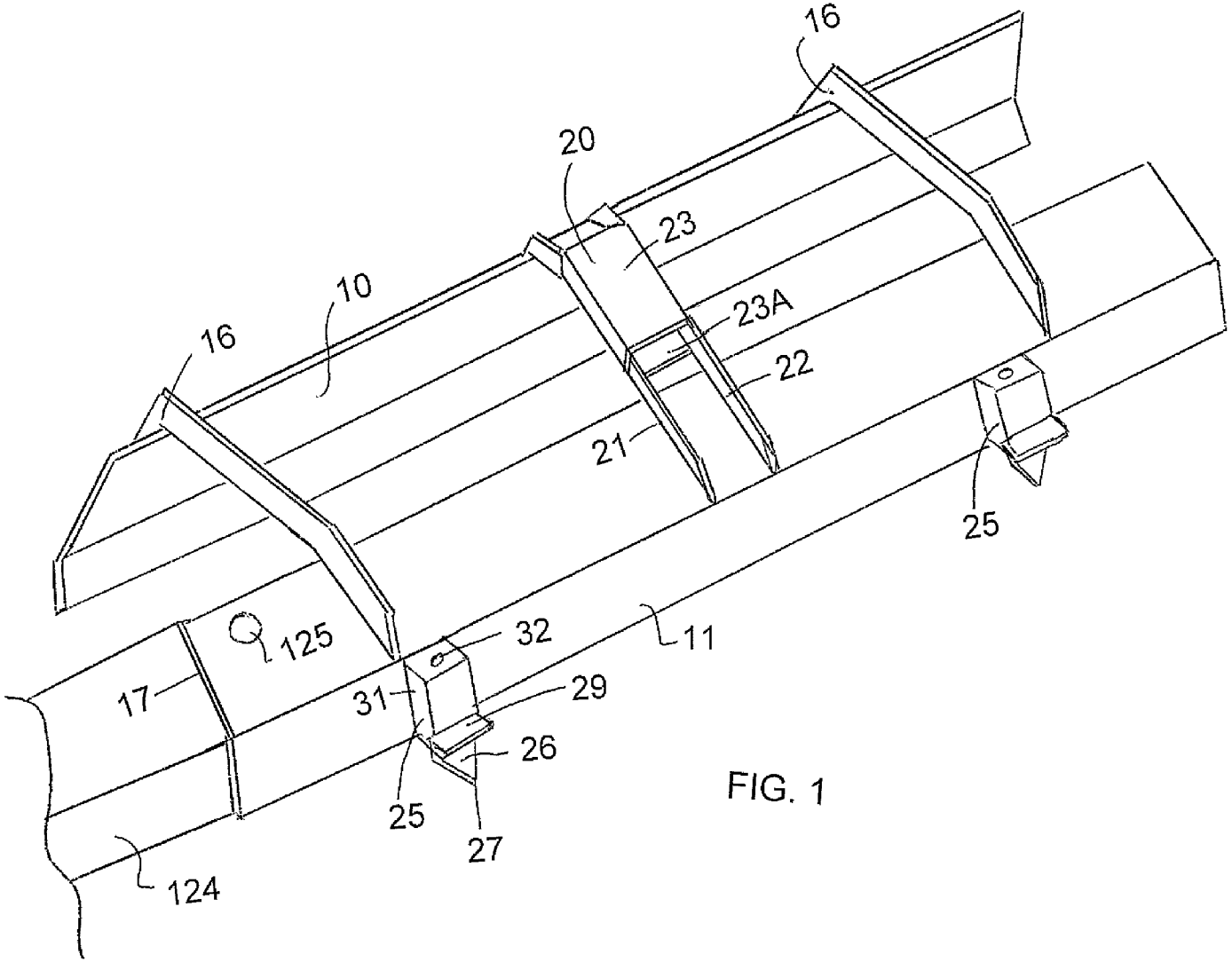
FIG. 1 is an isometric view of a form according to the present invention.
Figure 2:
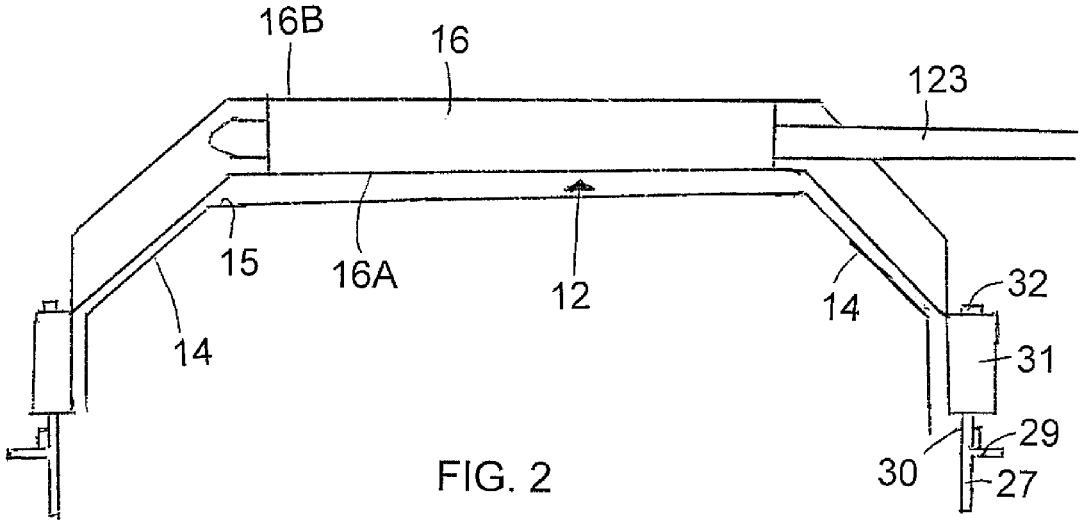
FIG. 2 is a cross sectional view through the form showing the form being lifted.
Figure 3:
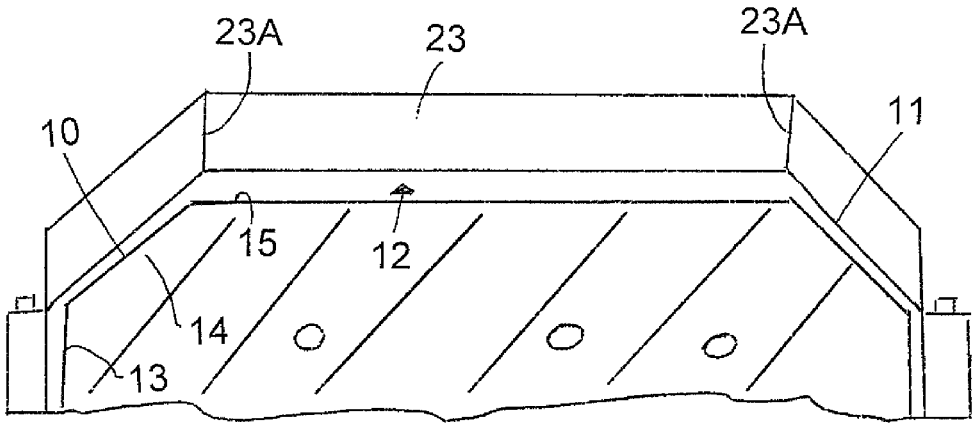
FIG. 3 is a cross sectional view of the form showing the concrete in place within the form.
Figure 4:
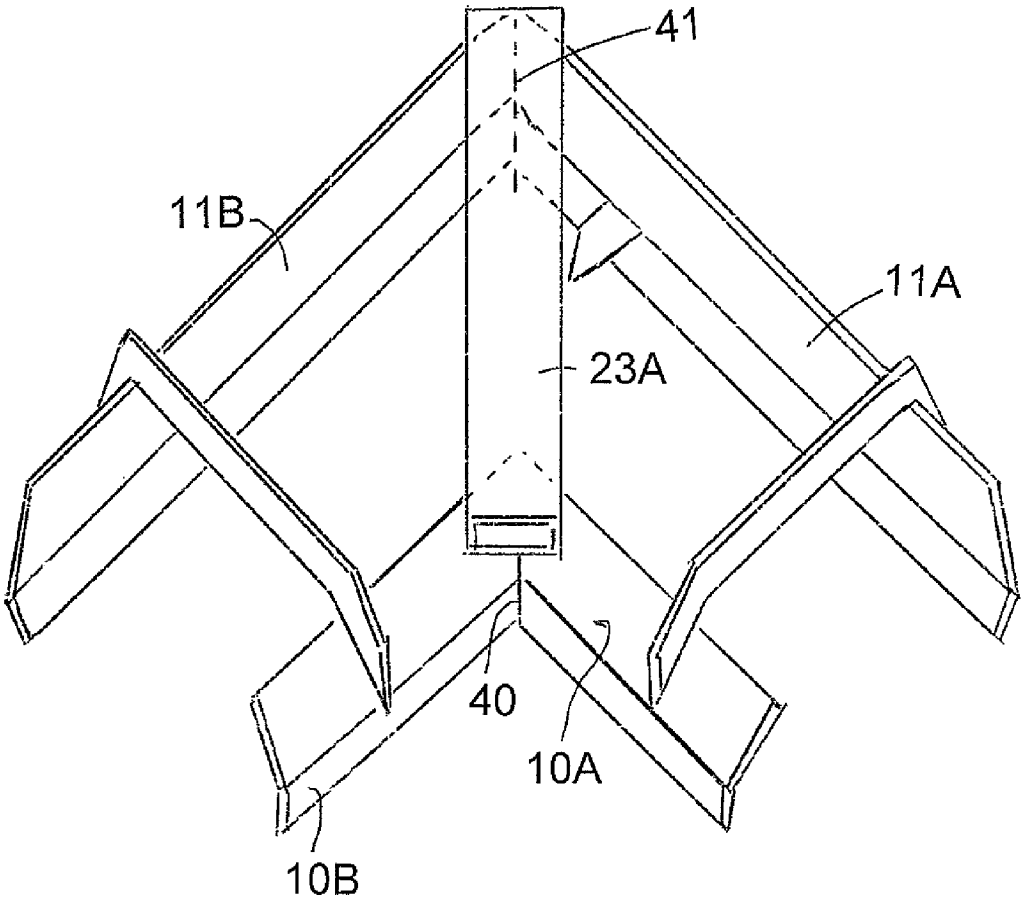
FIG. 4 is an isometric view of a corner piece with a series of forms of FIG. 1.

The forming system of the present invention comprises a plurality of forms which are arranged to be placed end to end or slightly overlapping to generate an elongate forming system for casting concrete or similar materials into an elongate structure. In FIGS. 1, 2 and 3 is shown a basic longitudinal form and in FIG. 4 is shown a corner form so that the forms can be arranged to generate sides and corners of a rectangular structure to be cast such as the footing for a basement or a pathway or other similar cast concrete structures.

The forms are arranged so that they can be readily lifted and inserted into place while avoiding or reducing the use of manual labour for lifting and locating the forms.

The forms can be pressed into place in the ground along a set line and at a required level using lines or laser levels or similar devices well known in the art for arranging the forms at the required height and position.

The forms can be used with a base so that one of the forms can be placed on the base and the remaining forms stacked on top of the first form. In this way the forms can be transported readily from one site to another and the forms can be re-straightened if they become distorted in use by rough handling by mounting the first on the base and mounting the others each on the next which acts to straighten all of the forms to the same pattern.

Additional forms can be provided in the same shape and arrangement which generate T-connections and other shapes such as 45 degree angles which may be required as will be well known to one skilled in the art.

The basic form as best shown in FIGS. 1, 2 and 3 comprises a pair of side walls 10 and 11 which are shaped to define side walls of the cast form leaving an open top 12 where the top of the form may be levelled. The shape includes a bottom vertical section 13 together with an inclined section 14 which extends from the top of the vertical section upwardly and inwardly to a top edge 15 at which is located the open top 12. This shape of form is particularly useful for forming a footing for a concrete basement wall where the wall is placed on top of the top surface of the cast concrete after the form is removed leaving a flat surface which has been smoothed through the open top of the form. The concrete wall is thus cast on top of the horizontal top surface so defined and stands upwardly therefrom. The form defines a wider base forming a footing which has the width of the space in between the vertical sections 13 of the two side walls. The inclined sections 14 provide an incline or chamfered corner at the top of the cast footing thus avoiding a sharp right angle corner which can be damaging to tires of vehicles and can chip and crack.

The two side walls 10 and 11 are connected at three spaced positions along their length so as to form a rigid form structure. At each end is provided an upstanding flange member 16 which is cut from a plate to define a bottom edge 16A at a top edge 16B. The bottom edge 16A is horizontal above the open top 12 and then inclines downwardly and outwardly over the inclined portions 14 and is welded thereto. Thus the bottom edge 16A is spaced above the top edge 15 so that the top surface of the concrete when cast at the opening 12 is below the bottom edge 16A of the horizontal section of the flange.

One such flange is provided at each end of the form at a position spaced inwardly from an end edge 17 of the side walls 10 and 11.

At the center of each form is provided a connecting and lifting mechanism generally indicated at 20 which is defined by two flanges 21 and 22 similar in shape and arrangement to the flanges 16 and between them is defined a tube 23 which extends across the horizontal section of each of the flanges 21 and 22. The tube 23 provides an open mouth 23A at each end between the two flanges 21 and 22 and facing outwardly over a respective one of the side walls 10 and 11. The tube 23 forms a mounting sleeve element into which the fork of a forklift system on a skid steer loader or similar vehicle can be inserted for lifting the form. The tube 23 forms a complete tube with a mouth at each end which is continuous between the two mouths. However it will be appreciated that parts of the material forming the mounting sleeve element can be removed to form a slot along the top if required or to form two separate spaced elements into which the fork can be inserted. The length of the tube may be reduced so that it does not extend across the full width of the horizontal section, provided it receives the fork 123 and acts to hold the form on the fork at a position and orientation located relative to the fork without significant twisting while it is lifted into place as shown in FIG. 2.

The form can thus be lifted with a single fork of a fork lift system and can be manoeuvred by steering the skid steel loader to a required position so that the fork is positioned at a required location relative to lining and levelling system.

Each of the side walls 10 and 11 carries a pair of locating legs 25. Thus the complete form has four such legs at spaced positions generally forming a rectangle so that the form can be placed on the ground and located at a required height and the height at each end and the height side to side can be adjusted by adjusting the legs.

Each leg comprises a plate 26 which is cut on each side to form a point or apex 27 which can be engaged into the ground. The engagement in the ground can be affected simply by pressing downwardly on the form structure by the fork of the forklift system.

In addition the legs include a horizontal flange 29 which is mounted on the plate forming the leg at a position spaced upwardly from the apex 27. Each of the legs is mounted on a screw 30 which can be adjusted upwardly and downwardly within a mounting sleeve 31 by adjustment of a nut 32 on top of the sleeve 31 by a wrench.

Thus in operation the form can be located at the required line by movement of the form on the forklift system to the required position, after which the form is pressed downwardly into the ground surface so that each of the legs bites into the ground until the flange 29 engages the ground.

With the form thus located in place on the ground, its height relative to a level is adjusted by an operator actuating the nuts 32 to move the mounting sleeve 31 and the respective side wall upwardly and downwardly relative to the leg and the flange 29 which is at the ground level.

In this way the forms can be aligned end to end and properly levelled so as to define a longitudinal form for receiving the cast concrete. After the casting of the concrete is complete, the forms can be lifted from the cast set concrete simply by inserting the fork of the forklift system back into the sleeve element 23 so as to lift the form away from the cast concrete.

As shown in FIG. 1, a plurality of connecting members is provided, one of which is shown at 124, each shaped to match a respective one of the side walls and clamped thereto on an inside surface thereof by a clamp 125 so as to bridge between a respective elongate frame member and a next adjacent elongate frame member. The clamp remains in place till the concrete is poured whereupon the concrete presses the bridging or connecting member outwardly to hold it against and bridging the two forms. In this way, a required length of formwork can be provided by selecting the required number of forms and locating them at spaced positions to make up the required length with the forms overlapped or spaced as required. The spaces are bridged by the connecting pieces 124.

Figure 5:
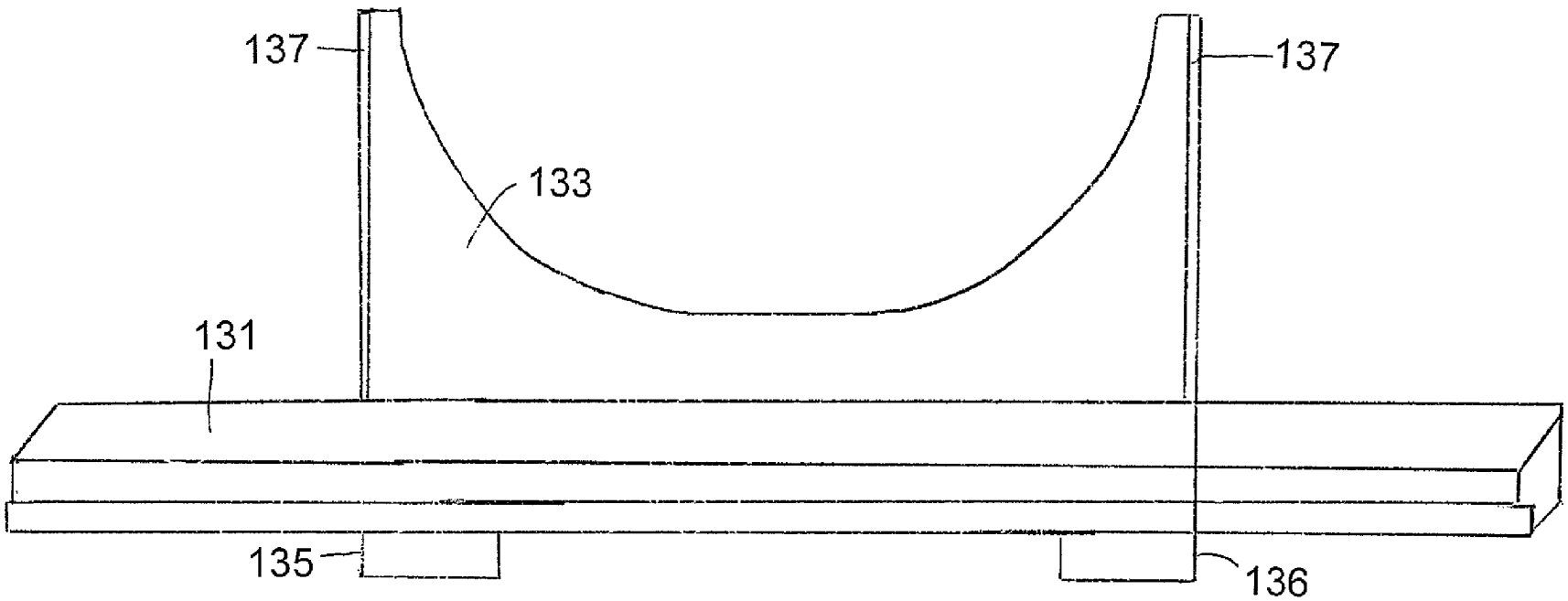
FIG. 5 is a side elevational view of a lifting cradle for stacking the forms.
Figure 6:
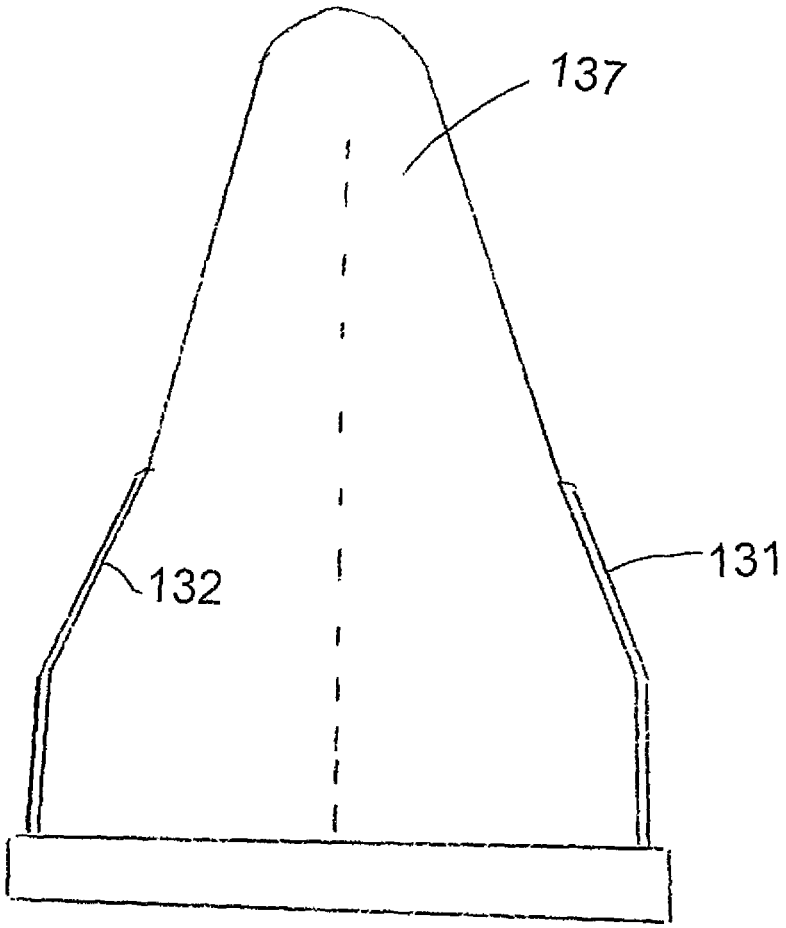
FIG. 6 is an end elevational view of the cradle of FIG. 5.

The forms can be lifted from their place by the fork lift system. They can be carried on a transport cradle on which the set of elongate frame members is stacked. The cradle shown in FIGS. 5 and 6 includes a pair of side walls 131 and 132 shaped to match the side walls of the forms on which a lowermost one of the set sits. The side walls are connected by a center bridge 133 in which the tube 20 sits with the flanges 16 on each side of the bridge. A pair of transverse sleeves 135 and 136 connected across the bottom of the side walls 131 and 132 are provided by which the cradle is lifted by the forks of the fork lift system. The bridge includes end plates 137 by which the cradle with the stack of forms thereon can be tied down for transport.

The forms are therefore reusable at a new site. In this way the amount of manual labour necessary for locating and aligning the forms is significantly reduced since the forms are lifted using the single fork of the forklift system.

The corner piece as shown in FIG. 4 includes the same side walls indicated at 10A and 10B together with the opposite side walls 11A and 11B where the side walls are connected at corners 40 and 41. A sleeve 23A spans the side walls at the corners 40 and 41 so that again the structure can be readily lifted by a single fork inserted through the sleeve 23A.

The forms can be lifted and held in place due to the rectangular shape of the tube 23 or 23A which matches the shape of the fork. The tube is located generally along the mid line of the form so that the form is balanced on each side of the tube to avoid significantly cantilevered loads.

In a situation where a skid steer loader with a fork is not available, the forms can be lifted by other systems including a simple crane or boom on a vehicle.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of laying a concrete footing comprising:

providing a set of forms each comprising, an elongate frame member arranged to define side walls forming an elongate area therebetween into which concrete can be cast for setting into a shape defined by the side walls;

providing on each of the frame members a first bridging member extending across the side waits thereof at or adjacent the top of the side mills so a to connect the side waits;

providing on each of the side walls of each of the frame members at least two legs at spaced positions therealong and extending downwardly from a bottom edge of the side was for engaging into the ground;

providing on each of the frame members further bridging members extending across the side walls thereof at or adjacent the top of the side walls so as to connect the side walls:

the first and further bridging member holding the side walls in generally parallol position a required spacing defining the area;

said first bridging member comprising a lift element defining a tubular opening extending in a direction transverse to the side walls;

lifting the frame member by inserting a fork of a fork lift vehicle through the tubular opening with the fork extending across the side walls;

placing the respective frame member at a required location;

engaging the legs on the frame member on the ground and pressing the frame member downwardly using the fork on the fork lift vehicle so that pressing on the frame member forces the legs into the ground to a required height relative to the ground;

with the legs engaged into the ground, adjusting the legs in height relative to the frame member so as to level the side walls of the frame member at a required orientation relative to the ground;

pouring the concrete between the side walls of the frame member;

and, after setting of the concrete, inserting the fork of the fork lift vehicle into the tubular opening of the first bridging member across the top of the concrete and across the frame member so a to lift the elongate frame member from the concrete.

2. The method according to claim 1 wherein the lift element is a sleeve.

3. The method according to claim 1 wherein there is a single lift element mid way along the frame member.

4. The method according to claim 1 wherein the lift element comprises a tube formed between two upstanding flanges connected across the side walls.

5. The method according to claim 1 wherein each side wall has two legs arranged adjacent respective ends of the side well and wherein the further bridging members are arranged at respective positions along the side walls which are adjacent the legs.

6. The method according to claim 1 wherein each leg includes a spike portion for engagement into the ground and a transverse flange for locating a depth of the leg relative to the ground.

7. The method according to claim 1 wherein each side wall includes a bottom vertical section and an upwardly and inwardly inclined upper section.

8. The method according to claim 1 including providing in the set of forms a corner piece for connecting longitudinal pieces wherein the corner piece includes a first side wall having two sections arranged at right angles to each other to define a corner an a second side wall having two sections at right angles to each other to define a second corner and a tubular the lift element which extends diagonally across the first and second corners.

9. The method according to claim 1 including providing a plurality of connecting members each shaped to match a respective one of the side walls and clamped thereto on an inside surface thereof so as to bridge between a respective elongate frame member and a next adjacent elongate frame member.

10. The method according to claim 1 including stacking the set of elongate frame members on a transport cradle.

11. The method according to claim 10 wherein the cradle includes a pair of side walls on which a lowermost one of the set sits with a pair of transverse sleeves connected across the side walls by which the cradle is lifted by the forks of the fork lift vehicle.

* * * * *